US009490562B2

(12) United States Patent
Verity et al.

(10) Patent No.: US 9,490,562 B2
(45) Date of Patent: Nov. 8, 2016

(54) REDUCED DIAMETER HYPERBOLOID ELECTRICAL CONTACT

(71) Applicant: QA TECHNOLOGY COMPANY, INC., Hampton, NH (US)

(72) Inventors: John Verity, Manchester, NH (US); Robert P. Lascelles, York, ME (US); Paul M. Gurrisi, Kingston, NH (US); Jeffery M. Brown, North Andover, MA (US)

(73) Assignee: QA Technology Company, Inc., Hampton, NH (US)

( * ) Notice: Subject to any disclaimer, the term of this patent is extended or adjusted under 35 U.S.C. 154(b) by 0 days.

(21) Appl. No.: 14/333,091

(22) Filed: Jul. 16, 2014

(65) Prior Publication Data

US 2015/0024641 A1 Jan. 22, 2015

Related U.S. Application Data

(60) Provisional application No. 61/847,735, filed on Jul. 18, 2013.

(51) Int. Cl.

| | |
|---|---|
| ***H01R 13/187*** | (2006.01) |
| ***H01R 13/33*** | (2006.01) |
| ***H01R 13/11*** | (2006.01) |
| *H01R 43/16* | (2006.01) |

(52) U.S. Cl.

CPC ..... *H01R 13/111* (2013.01); *H01R 13/187* (2013.01); *H01R 13/33* (2013.01); *Y10T 29/49174* (2015.01)

(58) Field of Classification Search

CPC .. H01R 13/187; H01R 13/111; H01R 43/16; H01R 13/33

USPC ..... 439/843, 675

See application file for complete search history.

(56) References Cited

U.S. PATENT DOCUMENTS

| | | | | |
|---|---|---|---|---|
| 4,657,355 | A | 4/1987 | Koch et al. | |
| 6,062,919 | A | 5/2000 | Trafton | |
| 6,767,260 | B2 * | 7/2004 | Beloritsky | H01R 13/187 439/843 |
| 7,191,518 | B2 * | 3/2007 | Beloritsky | H01R 13/187 29/747 |
| 7,775,841 | B2 * | 8/2010 | Coe et al. | 439/843 |
| 7,828,609 | B2 * | 11/2010 | Li et al. | 439/843 |
| 7,841,906 | B2 * | 11/2010 | Dent et al. | 439/675 |
| 8,647,159 | B2 * | 2/2014 | Steeves | 439/798 |
| 2004/0003498 | A1 | 1/2004 | Swearingen et al. | |
| 2004/0033732 | A1 | 2/2004 | Koch, Jr. | |
| 2008/0026645 | A1 * | 1/2008 | Naufel et al. | 439/798 |
| 2010/0191299 | A1 | 7/2010 | Ayzenberg | |

OTHER PUBLICATIONS

Stalcop,Inc., Cold Heading-Metal Forming Processes at High Speeds, Marketing Literature, retrieved from the internet at www.stalcop.com/cold-heading.php, Oct. 16, 2014.

* cited by examiner

*Primary Examiner* — Amy Cohen Johnson
*Assistant Examiner* — Matthew T Dzierzynski
(74) *Attorney, Agent, or Firm* — Preti Flaherty Beliveau & Pachios LLP

(57) ABSTRACT

A hyperboloid contact socket comprises a tubular body of conductive material having at one end an entrance aperture and cavity for receiving a mating pin terminal, and an integral termination extending from the opposite end of the tubular body. The tubular body contains a plurality of conductive wires attached at their inner ends to the inner surface of the tubular body at or near the bottom of the cavity by a press fit plug. The outer ends of the conductive wires are fastened to the tubular body by being wrapped around a reduced diameter section at the open end of the tubular body and secured by a press fit ring. The conductive wires are disposed within the tubular body in an angular disposition to form the shape of a single sheet hyperboloid.

19 Claims, 4 Drawing Sheets

REDUCED DIAMETER HYPERBOLOID ELECTRICAL CONTACT

CROSS REFERENCE TO RELATED APPLICATIONS

This application claims priority benefit of U.S. provisional patent application No. 61/847,735 filed Jul. 18, 2013 and is related to U.S. Pat. Nos. 6,767,260, 7,191,518 and 7,775,841, which are assigned to the assignee of the present application.

STATEMENT REGARDING FEDERALLY SPONSORED RESEARCH OR DEVELOPMENT

Not Applicable

BACKGROUND OF THE INVENTION

Hyperboloid electrical contacts or contact sockets are known for their reliability, resistance to vibration, low insertion force, low electrical resistance and high number of insertion/extraction cycles. A conventional hyperboloid contact socket includes an inner tubular sleeve which is open at both ends and which is located coaxially within two cylindrical sections that form an outer shell. The distal end of one of the outer sections is machined to form a cavity for permanently affixing wires to the contact either by soldering or crimping. Alternatively the distal end can be machined to form a pin to be soldered or press fit into a circuit board, or used to affix wires by wrapping them onto the pin. The proximal end of the second outer cylindrical section remains open to receive the male pin of a mating connector or device. A plurality of loose, or floating wires is arrayed within the inner sleeve to form the shape of a single sheet hyperboloid. At each end of the inner sleeve the wires are bent 180 degrees outward so as to return axially between the inner and outer sleeves. The wire ends are thereby retained at each end of the inner sleeve by means of a press fit between the wires and the inner and outer sleeves as shown in the prior art. Rolling, crimping, swaging or other suitable means to provide mechanical and conductive attachment is used to affix the outer sleeves at or near the axial midpoint of the inner sleeve. This contact configuration has been in use for many years and is known to present a difficult assembly task and to require expensive, high precision machined components. Additionally, due to the nature of the press fit retention of the wires, it is not uncommon for the wires to become separated from within the inner and outer sleeves, particularly during usage of the contact, thereby leading to field failures of the device in which it is in use. Additionally, this type of field failure can lead to damage of the mating male connector elements, further exacerbating the extent and cost of repair of the overall system in which the contact has been deployed. In addition, because of the concentric arrangement of the inner and outer cylindrical sections and the retained contact wires, the contact structure is larger in diameter than other forms of contacts and cannot therefore be used in applications requiring higher contact density, or in applications requiring the characteristics set forth above where miniaturization must be realized. Examples of the foregoing prior art are shown in U.S. Pat. Nos. 3,107,966, 3,229,356, 3,470,527 and 6,102,746.

More recently hyperboloid contact sockets have been developed which can be manufactured using automated high speed manufacturing processes wherein different types of terminations can be affixed to the contact socket as desirable for user requirements. This type of hyperboloid contact socket is described in U.S. Pat. No. 6,767,260 which is owned by the assignee of the present application. The socket includes a tubular body, one end of which has a lip defining an entrance aperture for receiving a mating pin. The tubular body contains a plurality of conductive wires welded or otherwise conductively and permanently affixed at their respective ends to the inner surface of the tubular body at respective ends of the body and disposed in an angular disposition with respect to the longitudinal axis to form a hyperboloid shape. The tubular body is attached to a termination at a junction by rolling, crimping, swaging or other suitable means to provide mechanical and conductive attachment.

The socket is formed via use of a mandrel having a plurality of spaced longitudinal wire receiving grooves. Wires are inserted within the grooves of the mandrel and the wires are inserted into the tubular body to the point at which the wires about the inner annular surface of the lip. The upper ends of the wires are permanently affixed, preferably by laser welding or other suitable means, to the confronting inner wall portion of the tubular body adjacent the lip.

The mandrel is then partially withdrawn and rotated with respect to the body by a predetermined angular extent to produce an angular orientation of the wires and the lower end of the wires are conductively and permanently affixed to the confronting wall portion of the tubular body, preferably by laser welding, or other suitable means, and the body and the mandrel are thereafter separated. The resultant body has the wires angularly disposed within the body so as to form a hyperboloid shape which accommodates and provides electrical engagement with a terminal pin that is inserted into the contact socket through the aperture. This type of hyperboloid contact socket offers the advantages of a smaller diameter, reduction in the number of machined components and suitability for automated high speed manufacture when compared to earlier hyperboloid contacts.

In one embodiment disclosed in U.S. Pat Nos. 6,767,260 and 7,191,518, one end of the mandrel is affixed to the body and a termination is affixed to the other end of the mandrel. One problem for this type of hyperboloid socket contact is that the overall length of the contact is increased due to the presence of the mandrel in the assembled socket. This makes the contact unsuitable for high density applications requiring a short contact, such as is the case in connectors where axial space is limited. In addition, this type of contact could be reduced in diameter still further, allowing for greater contact density, if it were not necessary to provide for terminations to be attached to the outside diameter of the mandrel.

It would be useful to provide a hyperboloid contact socket having a shorter overall length to permit its use in high power connector applications. It would also be useful to provide a hyperboloid contact socket having a smaller outside diameter to permit use in applications requiring closer center distance spacing. It would also be useful to reduce the cost of manufacturing through the elimination of unnecessary parts and through improvement in the efficiency of assembly by permanent and conductive attachment of the contact wires into position within a contact body to form the hyperboloid contact area. It would also be useful to provide a contact socket where the need for costly machined components is reduced or eliminated.

SUMMARY OF THE INVENTION

A hyperboloid contact or contact socket is provided having a reduced diameter and which can be manufactured in a cost efficient manner using automated high speed manufacturing processes and equipment. Different types of terminations can be provided for electrical connection to the contact as desirable to suit user requirements. The contact socket comprises a tubular body of metal or other suitable conductive material and having at one end an entrance aperture and cavity for receiving a mating pin terminal. A termination which preferably is integral with the tubular body extends from the opposite end of the tubular body. The tubular body contains a plurality of conductive wires affixed at their inner ends to the inner surface of the cavity in the tubular body at or near the bottom of the cavity by a press fit plug. The outer ends of the conductive wires are fastened to the tubular body by being wrapped around the open end of the tubular body, which has a reduced diameter, and secured by a press fit ring. The conductive wires are disposed within the tubular body in an angular disposition to form the shape of a single sheet hyperboloid. The body is preferably manufactured by cold heading which is less expensive than precision machined parts usually required by conventional designs, and which permits use of copper or other highly conductive material. As noted, the wires are attached to the tubular body through the use of a press fit plug at the inner end and by a press fit ring or collar at the open end. The respective ends of the conductive wires are flattened in section so as to permit a significant reduction in the diameter of the overall assembly. The respective flattened ends are butted together which allows for the wires to be self-spacing thus facilitating automated assembly. Further, the flattened self-spacing ends of the wires allows elimination of a separate tubular carrier or mandrel used in conventional hyperboloid contacts to support the conductive wires, thereby reducing cost as well as diameter.

Other features, aspects and advantages of the presently disclosed hyperboloid contact will be apparent to those of ordinary skill in the art from the Detailed Description of the Invention which follows.

BRIEF DESCRIPTION OF THE SEVERAL VIEWS OF THE DRAWINGS

The present invention will be more fully understood by reference to the following Detailed Description of the Invention in conjunction with the drawings of which.

DETAILED DESCRIPTION OF THE INVENTION

The disclosures of U.S. provisional application 61/847,735 filed Jul. 18, 2013 and U.S. Pat. Nos. 6,767,260, 7,191,518 and 7,775,841 are hereby incorporated by reference.

A hyperboloid contact or contact socket is provided which can be manufactured in a cost efficient manner using automated high speed manufacturing processes and equipment. Different types of terminations can be affixed to the contact socket as desirable to suit user requirements.

Figure 1:
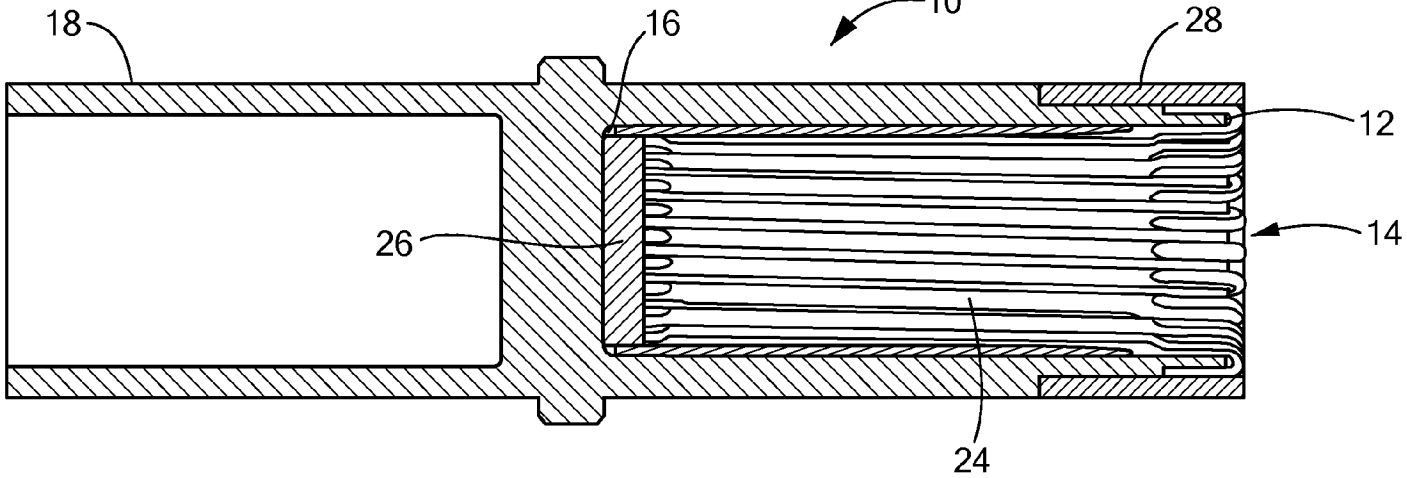
FIG. 1 is a cross-sectional side view of a hyperboloid contact in accordance with the present invention.

Referring to FIG. 1, a tubular body 10 of a suitable metal or other conductive material has an outer end 12 defining an aperture 14 for receiving a mating pin terminal (not shown). The inner end 16 of the tubular body is preferably integral with a termination 18 which in the illustrated embodiment is a crimp terminal. The termination 18 can be of any type suitable to a user's requirements. Examples of terminations are illustrated in FIG. 3 and include a solder cup, FIG. 3*a*, crimp type, FIG. 3*b*, a threaded stud, FIG. 3*c*, and a bus bar lug, FIG. 3*d*. The terminations may be of any other configurations suitable to the particular user requirements. In other embodiments, the termination of any intended type can be attached to the inner end of the tubular body by any suitable means such as soldering, welding, crimping or press fitting.

The tubular body is preferably manufactured by cold heading which permits use of copper or copper alloy or other suitably highly conductive material to provide improved current carrying capacity for the contact. The cold heading process is also less expensive than precision machining as utilized in manufacturing hyperboloid contacts of conventional construction.

Figure 2:
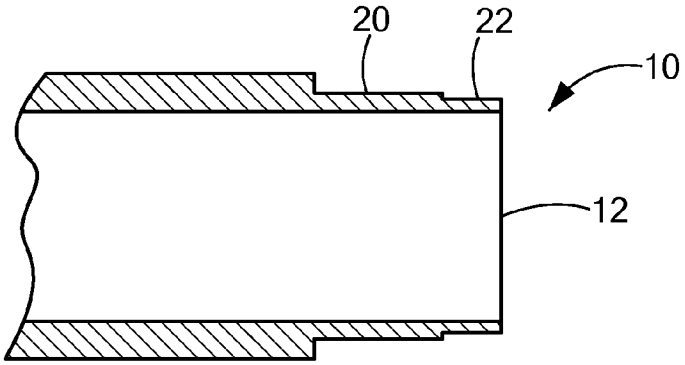
FIG. 2 is a cutaway cross sectional side view of the tubular body in accordance with the present invention.
Figure 3A:
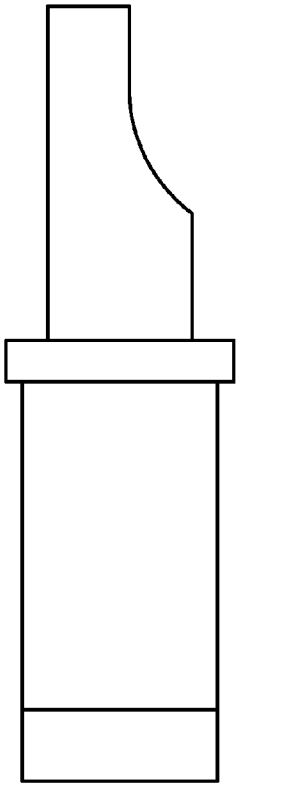
FIG. 3*a* is a side view of an embodiment of a hyperboloid contact in accordance with the present invention having a solder cup terminal as a termination.
Figure 3B:
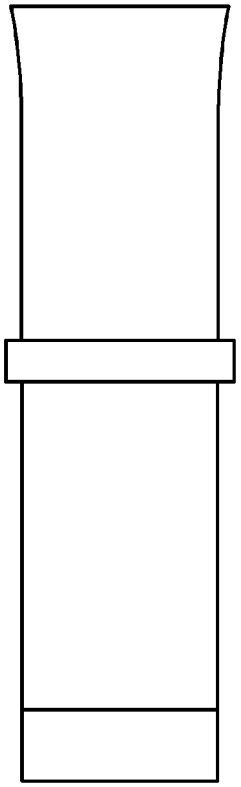
FIG. 3*b* is a side view of an embodiment of a hyperboloid contact in accordance with the present invention having a crimp barrel terminal as a termination.
Figure 3C:
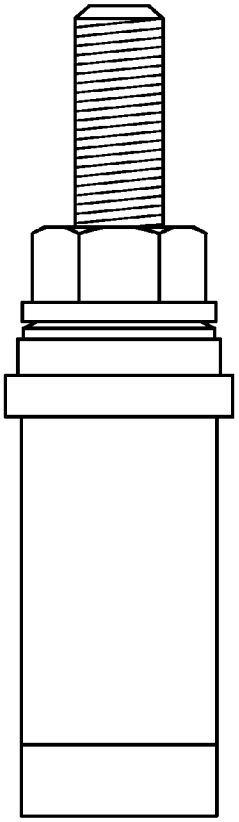
FIG. 3*c* is a side view of an embodiment of a hyperboloid contact in accordance with the present invention having a threaded stud terminal as a termination.
Figure 3D:
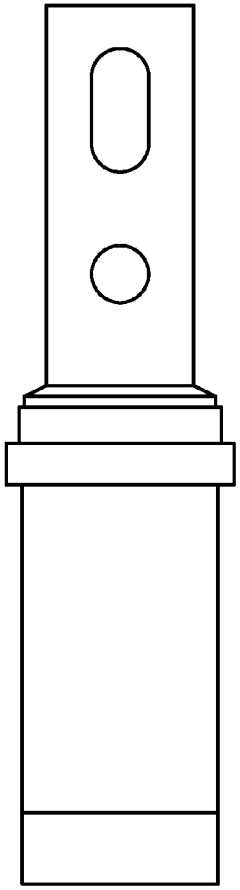
FIG. 3*d* is a side view of an embodiment of a hyperboloid contact in accordance with the present invention having a bus bar lug terminal as a termination.

The outer end 12 of tubular body 10 is shown in greater detail in FIG. 2 and has a section 20 of reduced or smaller diameter than the diameter of body 10. The outermost end of section 20 has a portion 22 which has a diameter smaller than that of section 20.

A plurality of conductive wires 24 are conductively and permanently affixed at the inner end of the annular cavity of the tubular body by being press fit between the circumferential surface of the cavity and the confronting surface of a solid plug 26 disposed at the inner end of the tubular body cavity. The plug has a diameter sized to provide the press fit with the flattened first wire ends. The ends of the conductive wires at the outer end of the tubular body are bent or wrapped around the outer end portion 22 of the tubular body and are press fit between the end portion 22 and the confronting surface of a ring or collar 28 which is fitted around the reduced diameter section 20 of the tubular body. In the illustrated embodiment, the ring 28 has an outer diameter substantially the same as the outer diameter of the tubular body to form a substantially continuous circumferential surface with the full diameter portion of the body 10. The ring has an inner diameter sized to provide the press fit with the flattened second wire ends. The plug 26 and ring 28 are preferably a suitable metal or other conductive material and may be of the same material as the tubular body. A typical material is a high conductivity copper alloy such as oxygen free copper or electrolytic tough pitch copper.

Figure 4:
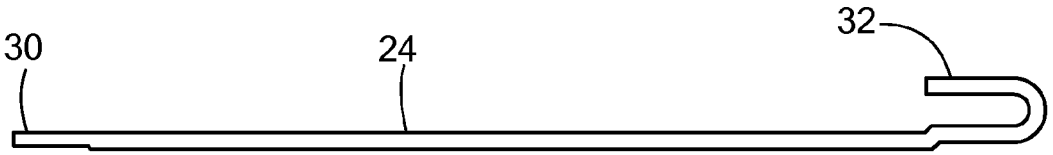
FIG. 4 is a side view of a conductive wire having flattened ends in accordance with the present invention.

The conductive wires are disposed in an angular position to the longitudinal axis of the tubular body to form a hyperboloid shape. The wires of the hyperboloid provide electrical contact with an inserted terminal pin which per se is known. The wires are made of beryllium copper or other suitable high conductivity stress relaxation resistant alloy, as an example. The conductive wires have flattened ends 30 and 32 as shown in FIG. 4 to reduce the accumulated diametrical growth of the wire material as the wires are press fit into place in the tubular body. The conductive wires are typically preformed with one end 30 flattened and the other end 32 flattened and bent into a generally U shape as illustrated for installation in the tubular body. The conductive wires are installed in the tubular body with the flattened ends of the wires in engagement with adjacent ones of the respective ends which allows the wires to be self spacing when located within the tubular body. The flattened ends 30 of conductive wires 24 are disposed about the circumference of the inner end 16 of tubular body 10 and retained in place by plug 26 which is press fit over the wire ends at the inner end of body 10. The flattened bent ends 32 of conductive wires 24 are disposed over the outer end of tubular body 10 about the circumference of portion 22. The wires are slightly thicker than the depth of portion 22 such that the wire ends 32 are retained in position by ring 28 which is press fit over the wire ends and section 20.

Figure 5:
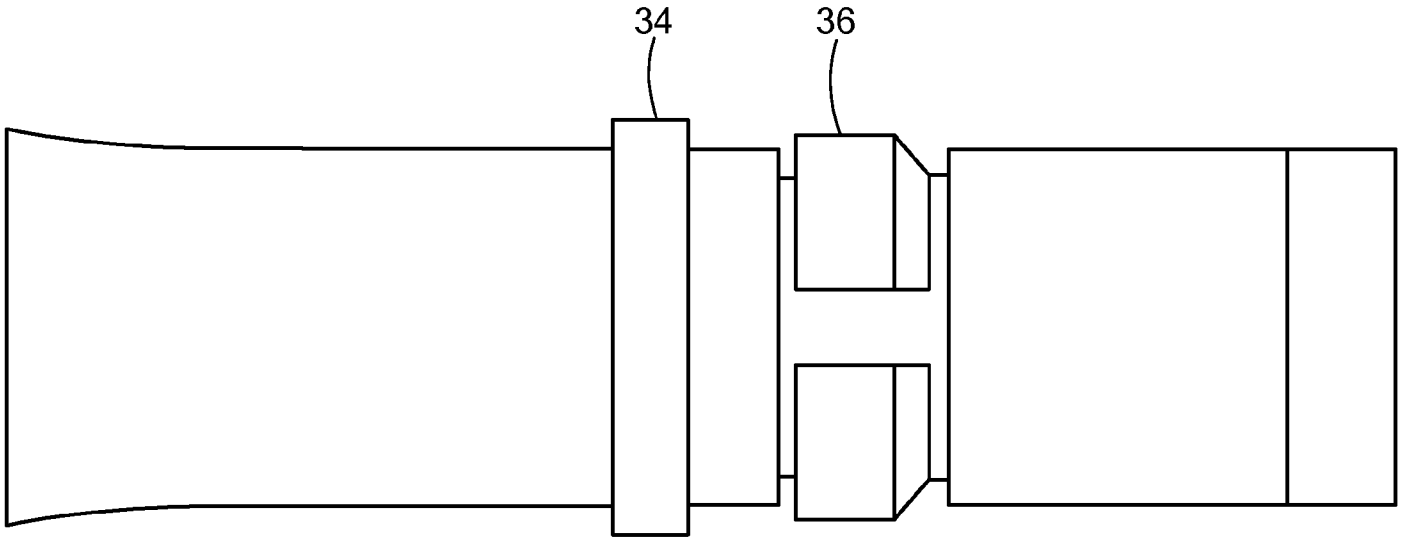
FIG. 5 is a side view of an embodiment of a hyperboloid contact in accordance with the present invention that includes a mounting shoulder and retention ring for retaining the contact within a housing.
Figure 6:
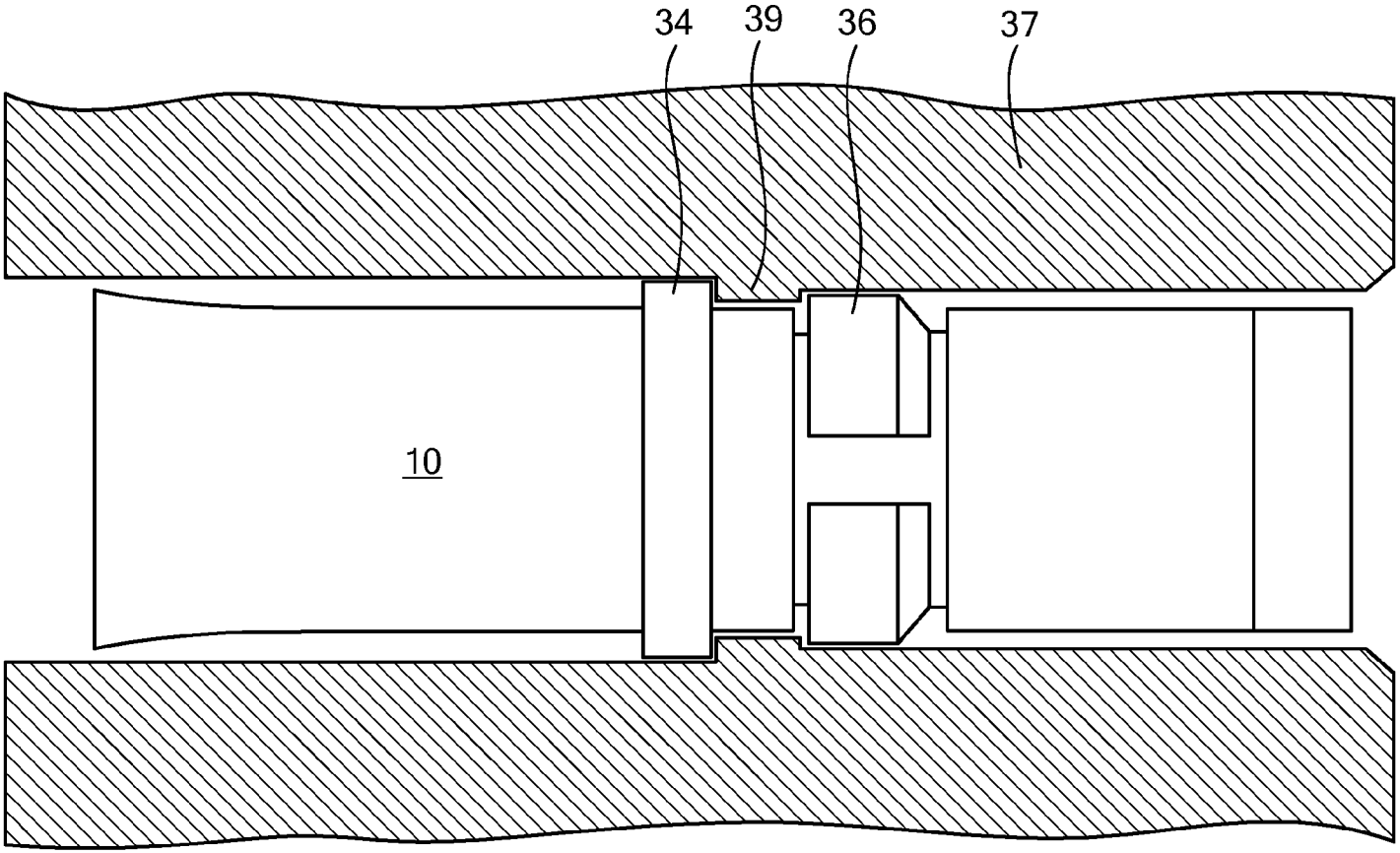
FIG. 6 is a partially cutaway side view of an embodiment of a hyperboloid contact in accordance with the present invention inserted within a housing.

Mounting features can be provided on the tubular body for cooperation with mounting elements of a housing in which the tubular body is inserted. For example, as shown in FIG. 5, the tubular body can include a shoulder 34 and/or a retention ring 36. The retention ring can be fabricated to expand and lock the contact socket into an associated housing. The tubular body is shown in FIG. 6 inserted in a housing 37. The housing has a tubular bore in which the tubular body is installed with the shoulder 34 abutted with an annular section 39 of the housing 37.

The contact according to the present invention is substantially smaller in diameter than prior constructions such as shown in prior patents noted above, that use a carrier to support the wires within the tubular body. In a typical embodiment, the present contact can be about 20% smaller in overall diameter than conventional designs. The present contact also has fewer parts than conventional types and therefore has reduced manufacturing costs.

The contact socket of the present invention is especially useful for high current applications and can be made in a range of sizes to suit user requirements. The contacts are typically fabricated to accommodate an electrical current range of 80 to 400 amps.

It will be appreciated that variations and modifications of the above described hyperboloid electrical contact may be made with departing from the spirit and true scope of the present invention. Accordingly, the invention should not be viewed as limited except by the full scope of the appended claims.

What is claimed is:

1. A hyperboloid electrical contact comprising:

a tubular body of conductive material, the tubular body having first and second ends and a longitudinal axis, said tubular body having an inner surface forming a cavity having an inner end adjacent the first end of the tubular body and an entrance aperture at the second end of the tubular body;

a plurality of wires having a general circular cross-section along a leangth of the wires and first and second ends, the first ends being flattened to provide first flattened ends having a centerline, a height, a width and outer edges, wherein the height is less than the width, the first flattened ends of said wires being disposed at the inner end of said cavity on the inner surface of said tubular body such that adjacent outer edges of the first flattened ends are generally abutting and the width of the first flattened ends defines a spacing between the centerlines of adjacent first flattened ends and, wherein the second ends of said wires being wrapped around the second end of the tubular body and confronting an outer surface of the tubular body;

a press fit plug disposed at the inner end of the cavity which affixes the first flattened ends of the wires between the inner surface of the cavity of the tubular body and a confronting surface of the plug;

a press fit ring disposed around the second ends of the wires at the second end of the tubular body which affixes the second ends of the wires between an outer surface of the second end of the tubular body and a confronting inner surface of the ring;

said plurality of wires disposed in angular relation with respect to said longitudinal axis and configured to form a hyperboloid socket within the cavity of the tubular body; and a termination at the first end of the tubular body.

2. The hyperboloid electrical contact of claim 1 wherein the tubular body has a diameter and the second end of the tubular body has a reduced diameter smaller than the diameter of the tubular body; and the press fit ring is sized and configured to fit around the reduced diameter at the second end of the tubular body.

3. The hyperboloid electrical contact of claim 1 wherein the second ends of the plurity of wires are flattened to provide second flattened ends and the second flattened ends are each generally in engagement with adjacent ones of the second flattened ends, thereby to self-space the plurality of wires disposed in the tubular body.

4. The hyperboloid electrical contact of claim 1 wherein:

the second end of the tubular body has a section of smaller diameter than the diameter of the tubular body and an outermost portion adjacent the entrance aperture which has a diameter smaller than the diameter of the section of the tubular body;

and wherein the second ends of said wires are wrapped around the outermost portion of the tubular body.

5. The hyperboloid electrical contact of claim 1 wherein:

the second end of the tubular body has a stepped down section composed of a first portion having a diameter smaller than that of the tubular body and a second portion adjacent the entrance aperture having a diameter smaller than that of the first portion;

and wherein the second ends of said wires are wrapped around the second portion of the tubular body.

6. The hyperboloid electrical contact of claim 1 wherein:

the press fit ring has an outer diameter substantially the same as the outer diameter of the tubular body to provide a substantially continuous circumferential surface with the tubular body.

7. The hyperboloid electrical contact of claim 1 wherein the second ends of the plurality of wires are second flattened ends and the press fit ring has an inner diameter sized to provide the press fit with the second flattened ends.

8. The hyperboloid electrical contact of claim 1 wherein:

the press fit plug has a diameter sized to provide the press fit with the first flattened ends.

9. The hyperboloid electrical contact of claim 1 wherein the termination is integral with the tubular body.

10. The hyperboloid electrical contact of claim 1 wherein the termination is attached to the inner end of the tubular body.

11. The hyperboloid electrical contact of claim 1 wherein the termination is a crimp terminal.

12. The hyperboloid electrical contact of claim 1 wherein the termination is a solder cup terminal.

13. The hyperboloid electrical contact of claim 1 wherein the termination is a threaded stud terminal.

14. The hyperboloid electrical contact of claim 1 wherein the termination is a bus bar terminal.

15. A method of making a hyperboloid electrical contact comprising the steps of:

forming by cold heading a tubular body of conductive material, the tubular body having first and second ends and a longitudinal axis, said tubular body having an inner surface forming a cavity having an inner end adjacent the first end and an entrance aperture at the second end;

forming a plurality of wires having first and second ends, the plurality of wires having a generally circular cross-section along a length of the wires and wherein the first ends of plurality of wires are first flattened ends, the first flattened ends having a centerline, a height, a width and outer edges, wherein the width is greater that the height;

disposing the first flattened ends of said wires at the inner end of said cavity on the inner surface of said tubular body with outer edges of adjacent first flattened ends disposed in generally abutting relation so that the width of the first flattened ends define a spacing between the centerlines of adjacent wires of the plurality of wires at the first flattened ends generally corresponding to the width of the first flattened ends;

press fitting a plug at the inner end of the cavity to affix the first flattened ends of the wires between the inner surface of the tubular body and a confronting surface of the plug;

rotating the second ends of the plurality of wires around the longitudinal axis with respect to the first ends of the plurality of wires so that the plurality of wires are angularly disposed with respect to the longitudinal axis within the tubular body to form a hyperboloid contact;

wrapping the second ends of said plurality of wires around the second end of the tubular body such that the second ends of the plurality of wires confront an outer surface of the second end of the tubular body;

press fitting a ring around the second ends of the wires at the second end of the tubular body to affix the second ends of the wires between the outer surface of the second end of the tubular body and a confronting inner surface of the ring; and providing a termination at the first end of the tubular body.

16. The method of claim 15 further including the steps of:

providing at the second end of the tubular body a section of smaller diameter than the diameter of the tubular body and an outermost portion having an outer surface, the outermost portion being adjacent the entrance aperture and having a diameter smaller than the diameter of the section of the tubular body, wherein the wrapping step comprises the steps of wrapping the second ends of said plurality of wires around the second end of the tubular body such that the second ends of the plurality of wires confront the other surfaces of the outermost portion of the tubular body.

17. The method of claim 15 further comprising:

flattening the second ends of the plurality of wires to provide second flattened ends; and wrapping the second flattened ends of said plurality of wires around the second end of the tubular body such that the second flattened ends of the plurality of wires confront the outer surface of the second end of the tubular body.

18. A hyperboloid electrical contact comprising:

a tubular body of conductive material having first and second ends and a longitudinal axis, said tubular body having an outer diameter, an inner surface forming a cavity having an inner end adjacent the first end and an entrance aperture at the second end, the second end of the tubular body having a stepped down section composed of a first portion having a first portion outer diameter smaller than the outer diameter of the tubular body and a second portion outer diameter adjacent the entrance aperture that is smaller than the first portion outer diameter;

a plurality of wires having first and second ends, the first ends of said wires being disposed at the inner end of said cavity on the inner surface of said tubular body and the second ends of said wires being wrapped around the second portion of the second end of the tubular body;

a press fit plug disposed at the inner end of the cavity which affixes the first ends of the wires between the inner surface of the tubular body and a confronting surface of the plug;

a press fit ring disposed around the second ends of the wires at the second end of the tubular body which affixes the second ends of the wires between an outer surface of the second end of the tubular body and a confronting inner surface of the ring;

said plurality of wires disposed in angular relation with respect to said longitudinal axis and configured to form a hyperboloid socket within the cavity of the tubular body; and a termination at the first end of the tubular body.

19. The hyperboloid electrical contact of claim 18 wherein the press fit ring has an outer diameter substantially the same as the outer diameter of the tubular body to provide a substantially continuous circumferential surface with the tubular body.

* * * * *